United States Patent [19]

Heline, Jr.

[11] 4,400,680

[45] Aug. 23, 1983

[54] OVERTEMPERATURE DETECTION CABLE

[75] Inventor: Ture A. Heline, Jr., Brookline, N.H.

[73] Assignee: Armtec Industries, Inc., Manchester, N.H.

[21] Appl. No.: 118,753

[22] Filed: Feb. 4, 1980

[51] Int. Cl.[3] ..... H01H 37/76

[52] U.S. Cl. ..... 337/415; 337/416

[58] Field of Search ..... 337/414, 415, 416, 393, 337/394, 395

[56] References Cited

U.S. PATENT DOCUMENTS

| | | | |
|---|---|---|---|
| 672,266 | 4/1901 | Gardner | 337/414 |
| 2,542,889 | 2/1951 | Baertl | 337/380 X |
| 4,134,092 | 1/1979 | Lavigne | 337/415 X |
| 4,237,513 | 12/1980 | Foldes | 337/415 X |

FOREIGN PATENT DOCUMENTS

| | | | |
|---|---|---|---|
| 170258 | 3/1905 | Fed. Rep. of Germany | 337/415 |

*Primary Examiner*—George Harris

*Attorney, Agent, or Firm*—Kenway & Jenney

[57] ABSTRACT

An overtemperature detection cable for use with a fire alarm system, a fire extinguishing system or the like comprises a coaxial assembly of an inner spring wire conductor in a core of thermoplastic dielectric material within an electrically conductive outer sheath. In one embodiment, the spring wire is initially coiled in a three-dimensional helical configuration, is thereafter uncoiled to approximate a straight wire, and is then disposed within the outer sheath to reside in the thermoplastic dielectric core. In a second embodiment, a straight inner spring wire and its surrounding thermoplastic dielectric core reside within an outer sheath, and the assembled sheath, wire, and thermoplastic dielectric material are then bent or crimped to assume a two-dimensional sinusoidal configuration. In both embodiments, when exposed to a predetermined excessive temperature, the thermoplastic dielectric material softens, permitting the inner spring wire conductor to contact the outer sheath and complete an electrical circuit in the associated system.

4 Claims, 6 Drawing Figures

OVERTEMPERATURE DETECTION CABLE

BACKGROUND OF THE INVENTION

The present invention relates generally to an improved overtemperature or fire detection cable and, more particularly, to an overtemperature or fire detection cable having an inner spring wire conductor maintained in substantial coaxial or spaced apart relation with a rigid, electrically conductive outer sheath by a thermoplastic dielectric material.

Prior art fire detection cables have commonly employed two wires wrapped or twisted about each other and electrically separated by their respective dielectric coverings which soften at a predetermined temperature. In such arrangements, a bias force is provided to bring the two wires into electrical contact when the dielectric material softens. This bias force is typically provided by twisting two flexible wires of approximately equal size together and then providing a covering for maintaining the bias force, or by wrapping a flexible outer wire around a larger inner wire.

However, such prior art fire detection cables are particularly susceptible to giving false indications when used in chemically hostile environments where vapors from chemicals such as toluene, cleaning agents and the like attack the dielectric cover and thus allow the wires to come into electrical contact. Also, the operating environment of such fire detection cables is often such that physical contact by heavy machinery and human operators cannot be avoided. This is especially true in off-road motor vehicle applications, in open surface mining operations and in other construction operations. Great difficulty has been experienced in protecting prior art twisted wire arrangements from physical injury, such as that caused by abrasion or compression, which tends not only to alter the amount of twist between the conductors, but which also deforms one or both of the insulating coverings, which coverings are relied upon to melt or otherwise soften in a predetermined and precise manner.

Further, a significant impairment of prior art fire detection cables has been experienced during installation when the cable is subjected to a misplaced hammer blow or accidental contact with a wrench during its attachment to a support member. Such unintentional contact may destroy or otherwise weaken the electrical insulation between conductor wires, as well as alter the amount of twist therebetween. Careful handling and securement is especially critical when installing such prior art fire detection cables which rely upon an accurate and uniform amount of twisting between the wire pair. Changes in the bias force between the wires are also likely to occur if the twisted wires are allowed to sag, for example, when the wires are suspended between two or more support points. Because the application of these cable arrangements is limited, in that they tend to sag when suspended between two points and cannot of themselves withstand pedestrian or light vehicular traffic, a costly conduit system may be required.

Moreover, even when properly installed and maintained, such fire detection cables report only the occurrence of a fire or an overtemperature condition and are not suitable for determining the exact location of the overtemperature condition. Also, in the instance of such condition, the fire can actually spread along the fire detection cable to other locations if the outer fabric covering of the cable ignites.

SUMMARY OF THE INVENTION

It is therefore a primary object of this invention to provide a novel and improved overtemperature detection cable which can maintain an accurate bias force between conductors over a prolonged period of time.

It is a further object of this invention to provide an overtemperature detection cable having a bias force between conductors which does not require accurate twisting of wires or other costly methods of assembly.

It is also a general object of this invention to provide an overtemperature detection cable having improved reliability with respect to contact closure upon reaching a predetermined temperature and which can maintain such reliability over prolonged periods of time.

It is another object of the present invention to provide a novel and improved overtemperature detection cable which can successfully withstand pedestrian or vehicular traffic and similar physical abuse.

To accommodate installation in a wide variety of environments, it is an object of this invention to provide an overtemperature detection cable which is self-supporting and which can withstand repeated physical contact, vibration, or abuse.

Also, it is an object of this invention to provide a standard production overtemperature detection cable which, without modification, can be safely used in explosive atmospheres, such as in coal mines, coal conveyors, granaries, chemically hostile environments, and the like, and which does not include any external combustible components.

Another object of this invention is to provide an overtemperature detection cable whereby the location of the exact position of an overtemperature condition or fire occurring at some point along the length of the cable can be determined.

These objects are accomplished in accordance with this invention by providing an overtemperature or fire detection cable comprising an assembly of an inner spring wire conductor in a core of thermoplastic dielectric material and an electrically conductive, substantially rigid, tubular outer sheath. More particularly, the inner spring wire electrical conductor is disposed within the tubular sheath in spaced or substantially coaxial relation with the outer sheath and is self biased for movement toward the interior sheath wall. The thermoplastic dielectric core surrounds the inner spring wire conductor within the sheath to electrically insulate the inner conductor from the outer sheath and maintain the conductor indefinitely in its initial configuration, out of contact with the interior sheath wall. Responsive to being heated above its predetermined melting temperature through the outer sheath, however, the thermoplastic dielectric material softens to allow the inner spring wire conductor to move into localized electrical contact with the interior sheath wall.

In a first embodiment, the inner spring wire conductor is initially coiled in a three-dimensional helical configuration and the coil is thereafter uncoiled to form a helix of reduced cross-sectional radius approximating a straight-line configuration. The inner spring wire exhibits a "memory" providing the bias which, responsive to softening of the thermoplastic dielectric material, urges the inner spring wire radially outwardly to reassume its helical configuration and thereby contact the interior wall of the conductive outer sheath.

The aforementioned objects are also accomplished in accordance with the principles of this invention in a second embodiment thereof by providing a normally straight inner spring wire conductor residing in a core of thermoplastic dielectric material. The wire and the surrounding thermoplastic dielectric core are then inserted into the electrically conductive outer sheath, and the assembled cable is crimped or bent to assume a sinusoidal configuration, the inner spring wire exhibiting a "memory" urging the inner spring wire to reassume its original straight line configuration and contact with the outer metallic sheath.

In either embodiment, the outer metallic sheath, formed preferably of stainless steel or similar metal, is rigid and capable of self-support such that the sheath is unaffected by pedestrian and light vehicular traffic and other common forms of physical contact.

BRIEF DESCRIPTION OF THE DRAWINGS

The features of this invention which are believed to be novel are set forth with particularly in the appended claims. The invention, together with its further objects and the advantages thereof, may be best understood, however, by reference to the following description taken in conjunction with the accompanying drawings, in which like reference numerals identify like elements in the several figures and in which:

DETAILED DESCRIPTION

Figure 1:
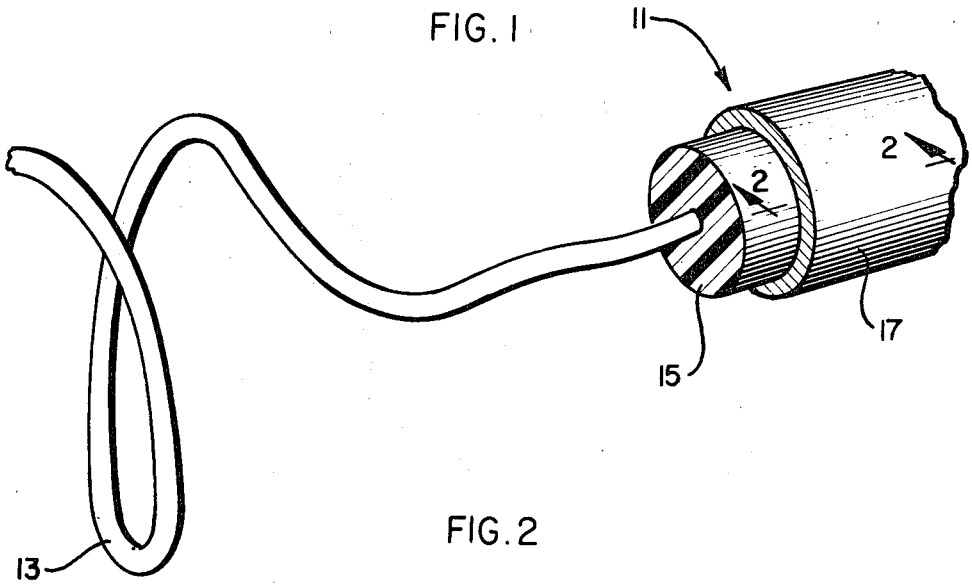
FIG. 1 is a perspective view, partly broken away, showing a first embodiment of the overtemperature detection cable of the present invention in which the inner spring wire conductor is initially coiled in a three-dimensional helical configuration and thereafter uncoiled to approximate a straight line configuration when assembled in the outer sheath.
Figure 2:
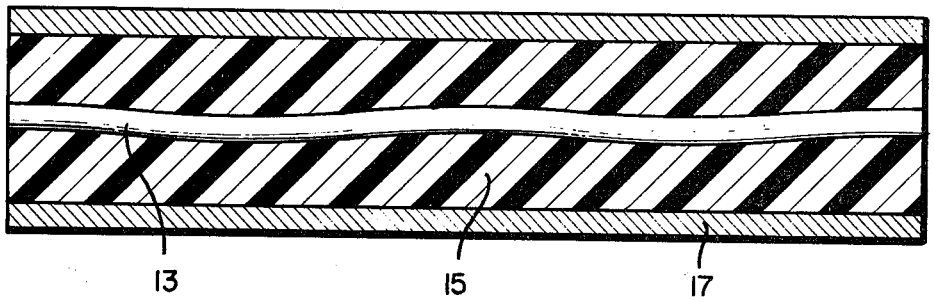
FIG. 2 is a sectional view taken along lines 2—2 in FIG. 1.

Referring now to FIGS. 1 and 2, in one embodiment of the present invention the subject overtemperature detection cable, identified generally by reference numeral 11, is shown to comprise an inner electrical conductor 13 having a core of thermoplastic dielectric material 15 disposed thereabout with the conductor 13 and the dielectric core 15, in turn, residing in an electrically conductive outer sheath 17 made from a non-corrosive material such as stainless steel.

Electrical conductor 13 is preferably a high-carbon spring steel wire exhibiting stiffness, shape retentiveness, elasticity and resiliency similar to wires referred to as piano wire or spring wire. In its relaxed, or unstretched, state, the spring wire 13 assumes a coiled, or helical, configuration, much like a spring coil, and because of its shape retentive, elastic and resilient properties, the wire 13, when deformed within its elastic limits from this initial helical configuration, is self-biased to return to that configuration. Thus, when the coiled wire is uncoiled and then released, the wire 13 moves radially outward in an attempt to reassume its original helical or coiled configuration. It is this radially outward bias, or "memory", that is relied on for circuit closure between the inner spring wire conductor 13 and the outer conductive sheath 17 when an overtemperature condition such as a fire occurs along the length of the overtemperature detection cable.

During the manufacture of the subject overtemperature detection cable shown in FIGS. 1 and 2, the inner spring wire 13 is initially uncoiled or stretched in the axial direction, thereby reducing the radius of the coil such that the wire 13 approximates a generally straight line configuration. A heat sensitive dielectric material such as a thermoplastic made, for example, from an eutectic material having a predetermined melting point in the temperature range between about 150 degrees Fahrenheit and about 500 degrees Fahrenheit is then applied to the wire 13 to encase it in a solid core of thermoplastic dielectric material which, when cold or unheated, is sufficiently rigid to hold the wire 13 in a radially compressed, or unexpanded, state. The material used is preferably ethyl cellulose, but a material such as vinylite, polyethelene, polyurethane may also be used. The dielectric core 15, with the inner spring wire 13 held therein in its compressed or approximately straight form, is then inserted into the conductive outer sheath 17 to form the overtemperature detection cable 11 shown in FIG. 1, the thermoplastic dielectric core 15 being dimensioned to maintain the inner spring wire conductor 13 in spaced or substantial coaxial relation with the outer sheath 17 and to isolate the inner conductor from the sheath so that no electrical contact is made therebetween.

If, thereafter, while installed and in use, the overtemperature detection cable 11 is heated sufficiently at some point along its length to exceed the predetermined melting point of the thermoplastic dielectric material, the thermoplastic dielectric material 15 at and immediately adjacent that point melts, releasing the inner spring wire conductor 13 at that point and allowing it to move outwardly to make localized electrical contact with the electrically conductive outer sheath 17. This is further illustrated in FIG. 3 where reference numeral 19 identifies a heat source such as an open flame or the like which is shown heating the sheath 17 of the cable. Owing to the thermal conductive properties of metallic sheath 17, the heat applied to the sheath is transferred therethrough to the underlying thermoplastic dielectric material 15. The temperature of the thermoplastic dielectric material 15 quickly follows the temperature of the metallic sheath 17, and when the overtemperature detection cable 11 experiences a temperature exceeding the melting point of the thermoplastic dielectric material, the dielectric material melts or softens thereby permitting the inner spring wire conductor 13, to reassume its initial helical configuration and contact the inner wall of outer sheath 17 at the point of overheating.

In a specific embodiment of this first form of the overtemperature detection cable of the present invention, it has been found that proper electrical contact between the inner spring wire conductor 13 and the electrically conductive outer sheath 17 is obtained when twenty-gauge high-carbon spring steel wire, initially coiled in a helical configuration of about 5.0 inches in diameter, is uncoiled so that it is approximately straight and then inserted into a stainless steel outer sheath having an inner diameter of about 0.08 inches and an outer diameter of about 0.10 inches. This preferably provides at least 0.015 inches of dielectric material between the stretched wire coil and the inner surface of the sheath. Also, the thermal sensitivity of the dielectric material can be enhanced by modifying the composition of the dielectric material to include a plasticizing agent, typically, a petroleum based material or chemical, which decreases the temperature at which the dielectric material softens.

Figure 3:
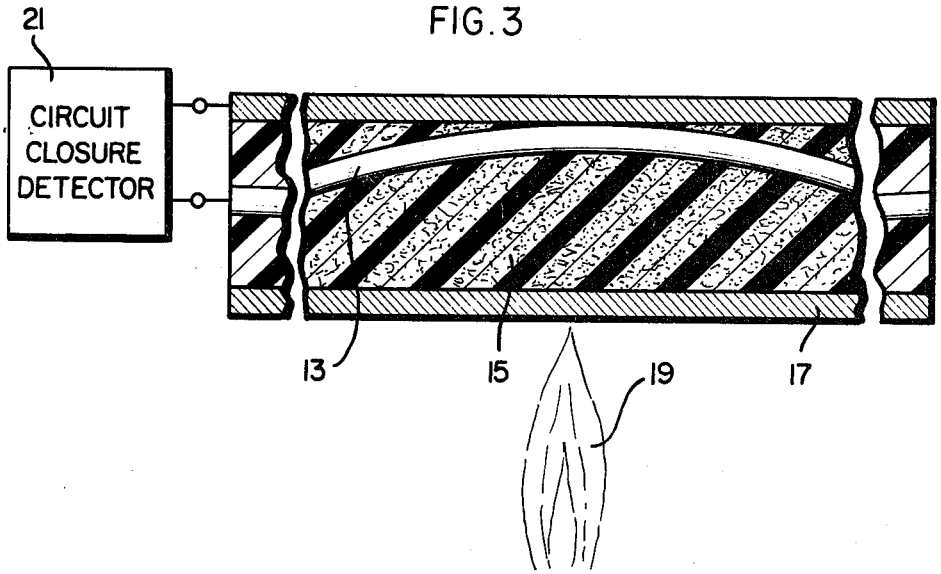
FIG. 3 is a sectional view similar to that of FIG. 2 illustrating the response of the overtemperature detection cable to an overtemperature condition or fire along its length and showing the overtemperature detection cable coupled to means for locating the point along the cable at which an overtemperature condition such as a fire has been detected.

As shown in FIG. 3, a circuit closure detector 21, e.g., a reflectometer, can be connected to the overtemperture detection cable 11 to pinpoint the location of the fire or hot spot 19 along the cable, the detector 21 being electrically connected between the electrically grounded outer sheath 17 and the coaxial inner spring wire conductor 13 at one end of the overtemperature detection cable. If a reflectometer is utilized, the reflectometer, as is known in the time domain reflectometry art, generates a wave which travels down the length of the coaxial overtemperature detection cable 11 to the point where the inner spring wire conductor 13 and the outer sheath 17 are in electrical contact. The wave is then reflected back toward the reflectometer, and by measuring the amount of time it takes for the wave to return, the distance along the cable 11 to the point of closure can be calculated with accuracy. It will be understood, however, that other circuit closure detectors can also be used in conjunction with the overtemperature detection cable of the present invention.

Figure 4:
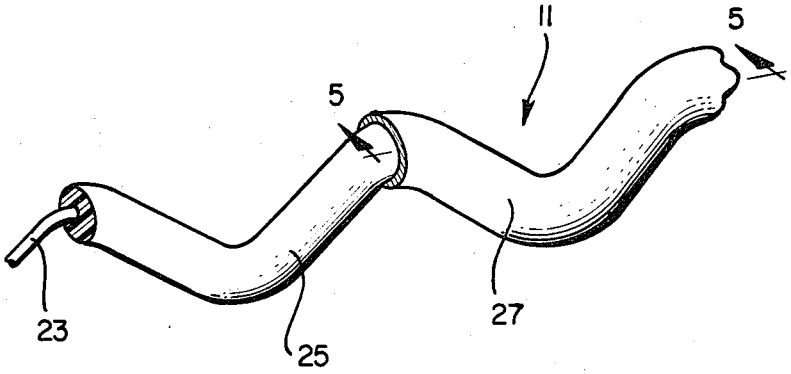
FIG. 4 is a perspective view, partly broken away, showing a second embodiment of the overtemperature detection cable of the present invention in which the cable, after assembly, is crimped or bent to assume a sinusoidal configuration.
Figure 5:
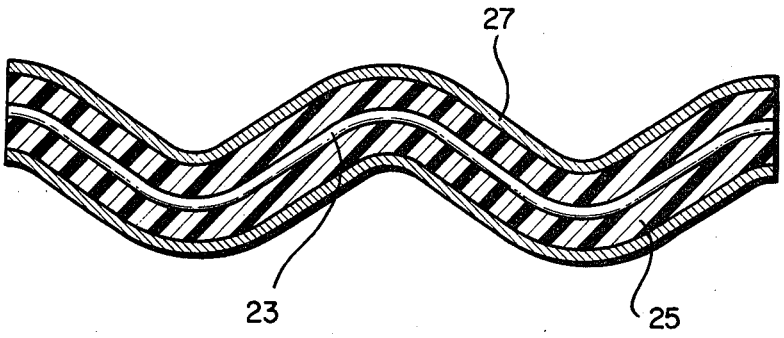
FIG. 5 is a sectional view taken along lines 5—5 in FIG. 4.

With reference now to FIGS. 4 and 5, in a second embodiment of the present invention the overtemperature detection cable 11 is shown to comprise an inner electrical conductor, or spring wire, 23 having a surrounding thermoplastic dielectric core 25 and residing within an electrically conductive outer sheath 27. This embodiment of the overtemperature detection cable 11 differs from the abovedescribed first embodiment in that the inner spring wire conductor 23, although having characteristics of shape retentiveness, resiliency and elasticity similar or identical to those of wire 13 in the first embodiment, is not formed in a helical configuration. Instead, in its relaxed state, before assembly of a cable 11, the inner spring wire conductor 23 is substantially straight. During assembly, however, after the wire 23 with the dielectric material 25 disposed thereabout is inserted into the outer sheath 27, the cable 11 is crimped or bent to assume the two-dimensional sinusoidal configuration shown in FIGS. 4 and 5, the inner wire 23 and the thermoplastic dielectric core 25 assuming the same configuration such that the inner spring wire conductor 23 is substantially coaxially disposed in the electrically conductive outer sheath 27.

Inner conductor 23, being of a self-biasing high-carbon spring steel material, exhibits a "memory" that biases it to reassume its initial straight line configuration. Under normal conditions, the thermoplastic dielectric material 25 fills the entire space between the inner spring wire 23 and the outer sheath 27, thereby requiring the inner wire to assume the sinusoidal configuration of the cable 11. In use, however, if the cable is in the vicinity of a fire or other source of heat 29 such that the outer sheath 27 of the cable is heated, the heat is conducted therethrough to heat the thermoplastic dielectric core material 25. When the temperature of the dielectric material 25 reaches or exceeds the predetermined melting temperature of the material, the themoplastic dielectric core material melts or softens to permit the inner spring wire conductor 23 to reassume its straight line configuration and thereby contact the electrically conductive outer sheath 27 over a localized length of the cable, as shown at point 29 in FIG. 6, to complete an electrical circuit at that point. Again, the circuit closure detector 21 or reflectometer may be coupled to the inner wire 23 and the outer sheath 27 to determine the location of the fire.

Figure 6:
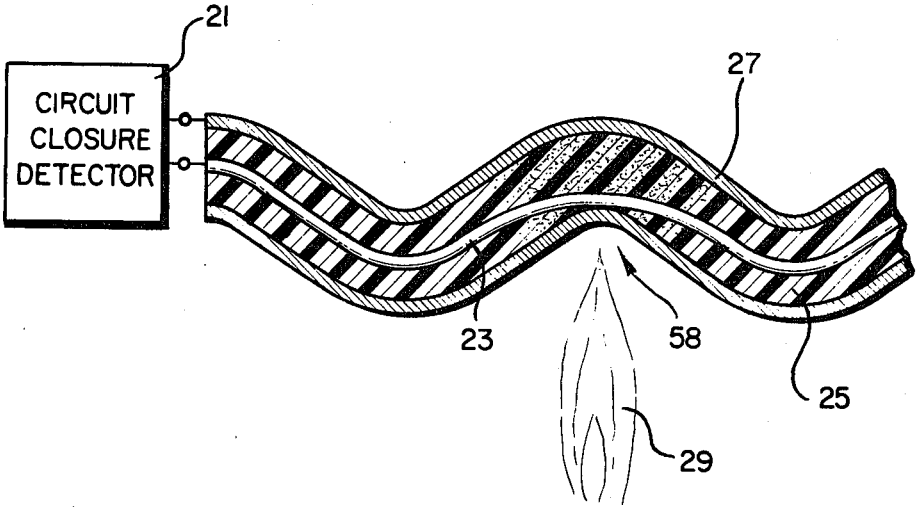
FIG. 6 is a sectional view similar to that of FIG. 5 illustrating the overtemperature detection cable of the second embodiment in an operative condition wherein the center conductor of the cable has contacted the outer sheath of the cable responsive to an overtemperature condition such as that caused by a fire.

In one embodiment of the overtemperature detection cable shown in FIGS. 4–6, the cable is dimensioned similarly to the first embodiment described above, and the sinusoidal configuration of the cable 11 has a period of about one and onehalf inches between adjacent peaks and a peak-to-peak magnitude of about 0.30 inches. Although these dimensions can be varied, it will be understood that the resolution, the term "resolution" meaning the capability of the cable to sense and respond to heat along a relatively short length of the cable, is limited by the sinusoidal configuration of the overtemperature detection cable 11 itself. The configuration of this particular embodiment of cable 11 will produce a reliable closure between the inner spring wire conductor 23 and the electrically conductive outer sheath 27 when the source of heat is sufficient to melt or soften the thermoplastic dielectric core for a minimum distance of about 0.5 inches along the cable. This minimum length is that which must be heated to cause a reliable contact closure when the heat source is positioned midway between peaks of the cable.

Both embodiments of the overtemperature detection cable of the present invention can be advantageously used in environments where such cables are subject to physical abuse and where fires are normally difficult to detect. For example, in coal conveyor systems and in other similar apparatus, it is, of course, desirable to minimize damage caused by fire extinguishing systems. The overtemperature detection cables disclosed herein can be advantageously used to determine which ones of the extinguishers are to be operated in response to the overtemperature signal developed in cooperation with the cable. Without this ability to determine the exact location of the fire or overtemperature condition along the conveyor, all of the extinguishers along the length of the coal conveyor would have to be turned on in an effort to extinguish a fire occurring along only a portion thereof.

Another application of the overtemperature detection cable disclosed herein is found in large earth moving and other off-road vehicles where the operator is typically isolated from the engine compartment and the hydraulic systems. It is possible, therefore, that the operator will not always be aware that a fire has ignited. Accordingly, the overtemperature detection cables of the present invention may be installed in the vehicle at points where a fire or other overtemperature condition is likely to occur to alert the operator and permit corrective action to be taken or to automatically operate fire extinguishing apparatus.

Accordingly, the overtemperature detection cable of the present invention represent a significant advance in the art in that overtemperature detection cables of rugged construction are provided which can withstand pedestrian and vehicular traffic and still operate successfully in hostile environments and which will accurately maintain the bias force between the inner coaxial spring wire conductor and the outer, electrically conductive sheath of the cable. The subject overtemperature detection cables are also able to withstand vibration and shock such as experienced in off-road vehicles and do not require costly conduit systems or the like. Further, the overtemperature detection cables of the present invention do not burn and can be placed in corrosive or otherwise chemically hostile environments, the stainless steel outer sheath providing the required chemical isolation of the thermoplastic dielectric material from the environment. Moreover, these cables, being coaxial, permit the use of time domain reflectometry to pinpoint the location of a fire along the cable such that fire extinguishing systems or the like can be selectively enabled in the localized area of the fire. Thus, it can be seen that the overtemperature detection cable herein provided have improved resolution, greater mechanical strength, and the ability to maintain accurate operating characteristics when suspended over long spans for long periods of time.

While particular embodiments of the present invention have been shown and described, it will be obvious to those skilled in the art that various changes and modifications may be made without departing from the invention in its broader aspects. Accordingly, the aim in the appended claims is to cover all such changes and modifications which may fall within the true spirit and scope of the invention.

What is claimed is:

1. An overtemperature detection cable for completing an electrical circuit responsive to being heated above a predetermined temperature, said cable comprising:

an electrically conductive, substantially rigid outer sheath of generally sinusoidal configuration and having an interior wall;

an inner spring wire electrical conductor disposed within said outer sheath in a generally sinusoidal configuration and spaced from said interior sheath wall to be in substantial coaxial relation with said outer sheath;

said inner spring wire conductor being self-biased to assume a generally straight configuration and for movement toward said interior sheath wall; and a thermoplastic dielectric material surrounding said inner spring wire conductor within said sheath for maintaining said inner spring wire conductor indefinitely in a sinusoidal configuration out of contact with said interior sheath wall and for electrically insulating said inner spring wire conductor from said outer sheath, said thermoplastic dielectric material having a predetermined melting temperature and softening responsive to being heated above said predetermined melting temperature through said outer sheath to allow said inner spring wire conductor to assume said approximately straight configuration and move into localized electrical contact with said interior sheath wall.

2. The fire detection cable as recited in claim 1 wherein said outer sheath is formed of stainless steel tubing.

3. The fire detection cable of claim 1 wherein said inner spring wire conductor is a high-carbon spring steel wire exhibiting shape retentiveness, elasticity, and resiliency.

4. The fire detection cable of claim 1 wherein said thermoplastic dielectric material is formed of one of the group comprising ethyl cellulose, vinylite, polyethylene, and polyurethane.

* * * * *